US005706966A

United States Patent [19]

Rothe

[11] Patent Number: 5,706,966

[45] Date of Patent: Jan. 13, 1998

[54] MULTIPLE TIER DESSERT CONTAINER

[76] Inventor: Donna Torreano Rothe, 18665 Midland Pl., Brookfield, Wis. 53045

[21] Appl. No.: 670,333

[22] Filed: Jun. 25, 1996

[51] Int. Cl.[6] ..... A47F 10/06; B65D 85/00

[52] U.S. Cl. ..... 220/23.83; 206/563; 206/564; 206/565; 220/768; 220/772; 220/792; 312/330.1; 312/351

[58] Field of Search ..... 206/449, 514, 206/557, 562, 563, 564, 565, 216; 211/71, 84, 134, 186, 187, 188, 190; 220/23.83, 400, 480, 529, 532, 533, 501, 503, 505, 661, 768, 769, 770, 771, 792, 793; 312/236, 244, 293.1, 293.3, 330.1, 334.27, 348.3, 351, 351.1, 351.11

[56] References Cited

U.S. PATENT DOCUMENTS

| | | | |
|---|---|---|---|
| 1,012,276 | 12/1911 | Pritchard | 220/768 |
| 1,267,388 | 5/1918 | Dodson | 312/293.3 |
| 2,225,762 | 12/1940 | Barnsteiner | 312/351 |
| 2,695,645 | 11/1954 | Tupper . | |
| 2,752,970 | 7/1956 | Tupper . | |
| 3,063,771 | 11/1962 | Hare | 312/351 |
| 3,079,206 | 2/1963 | Glezen | 312/351 |
| 3,238,004 | 3/1966 | Goebel . | |
| 3,338,651 | 8/1967 | Jacobson | 312/330.1 |
| 3,511,288 | 5/1970 | Swett et al. . | |
| 3,846,004 | 11/1974 | Relyea | 312/351 |
| 3,861,433 | 1/1975 | Schier et al. | 220/793 |
| 3,992,069 | 11/1976 | Kitterman | 312/244 |
| 4,026,351 | 5/1977 | Biava | 312/236 |
| 4,093,041 | 6/1978 | Davies et al. | 206/562 |
| 4,114,760 | 9/1978 | Entenmann | 206/562 |
| 4,123,128 | 10/1978 | Abele | 312/244 |
| 4,499,998 | 2/1985 | Carlson | 220/532 |
| 5,154,306 | 10/1992 | Wyatt | 220/770 |
| 5,240,320 | 8/1993 | Yerman | 312/293.3 |
| 5,440,785 | 8/1995 | McDonald | 220/769 |

*Primary Examiner*—Jimmy G. Foster
*Attorney, Agent, or Firm*—Donald J. Ersler

[57] ABSTRACT

A multiple tier dessert container includes a container, a lid, a plurality of trays, and at least one handle. The container has a top surface, a bottom surface, a first end, a second end, a first side and a second side. The perimeter of the first end of the container is terminated with an angled edge of uniform thickness. The recessed cavity extends around the perimeter thereof, and is sized to be received by the angled edge of the container such that the lid snugly fits onto the container. The first side and second side have a plurality of ledges which are formed therein. Each tray has a length, a width and at least one area for storing decorated desserts. The size of the storage area is dictated by the size of decorated dessert. The width of each tray is sized to slidably fit in the container. The length of each tray is sized to firmly fit between an attached lid and the second end of the container.

29 Claims, 3 Drawing Sheets

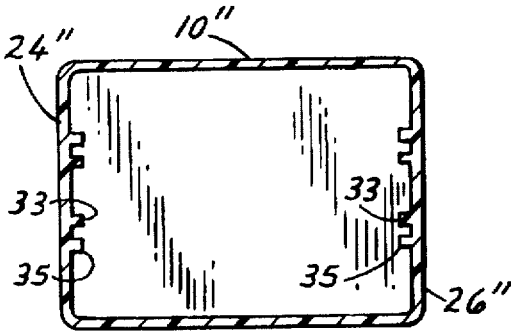
FIG. 3c
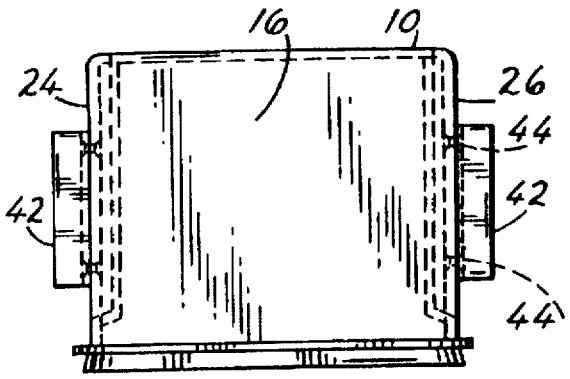
FIG. 4
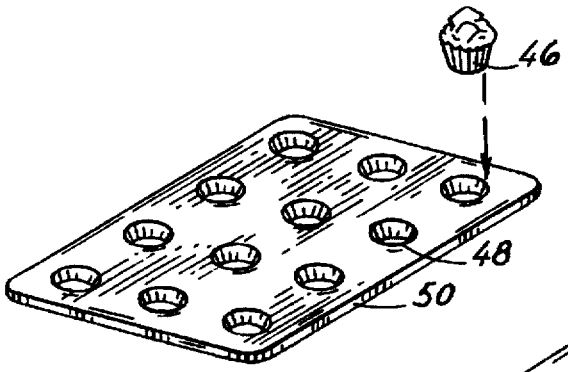
FIG. 5a
FIG. 5b
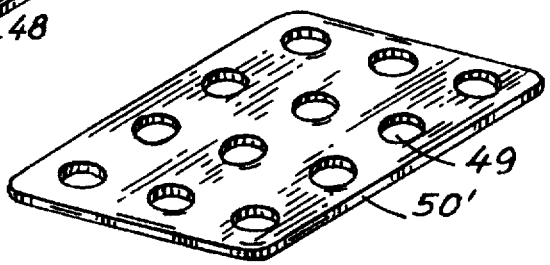
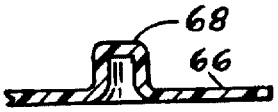
FIG. 7b
FIG. 6
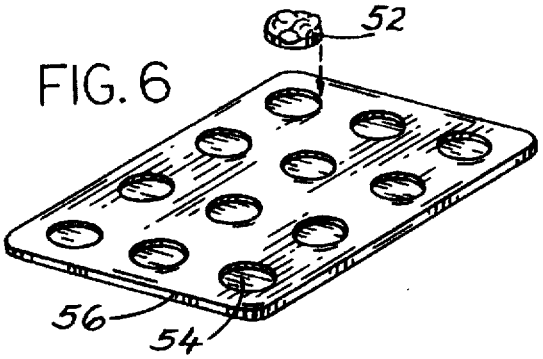
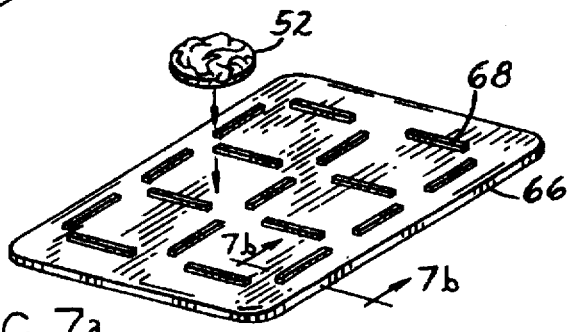
FIG. 7a

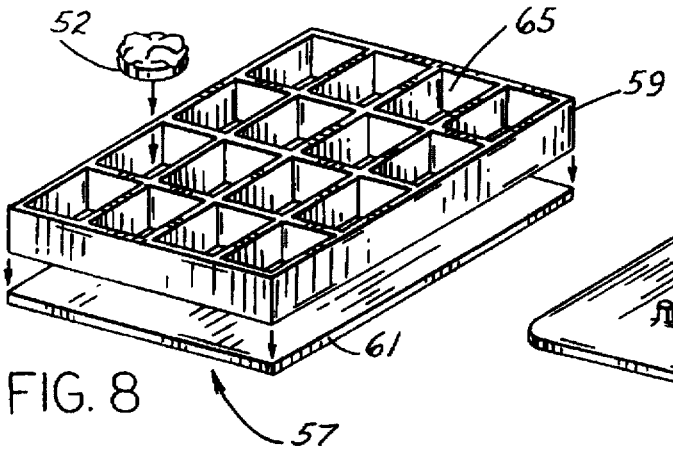
FIG. 8
FIG. 9a
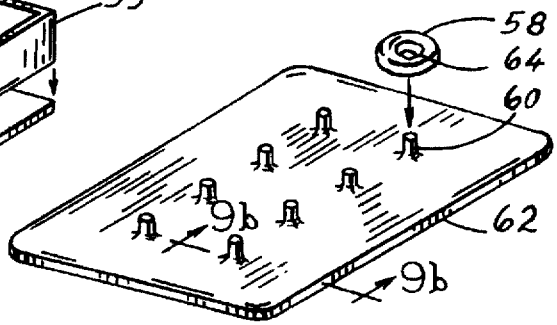
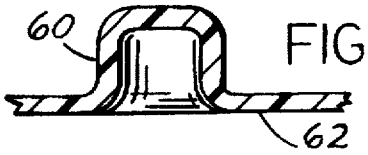
FIG. 9b
FIG. 10
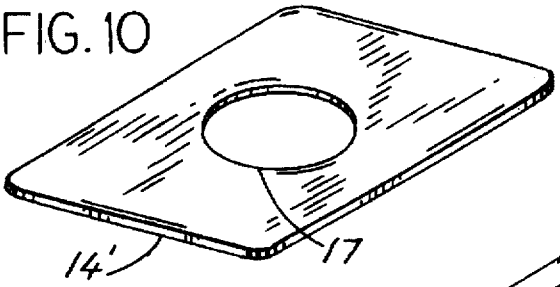
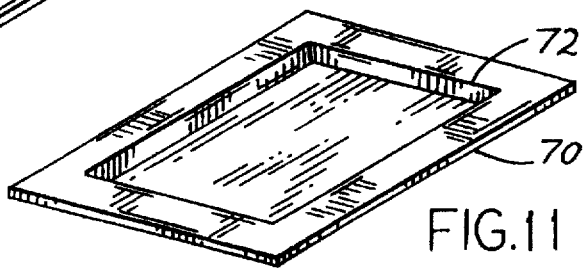
FIG. 11
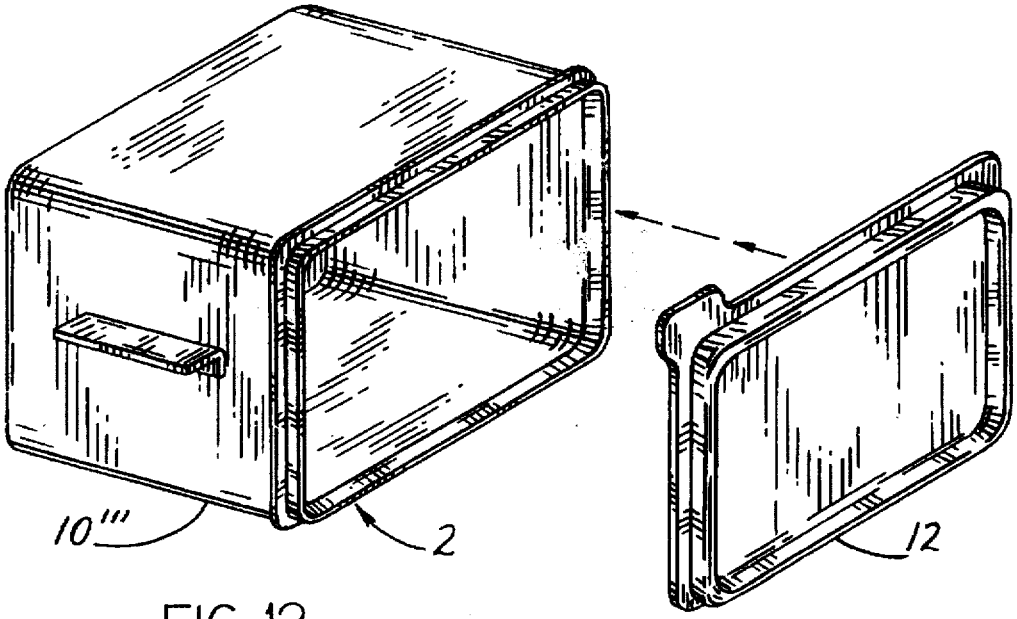
FIG. 12

MULTIPLE TIER DESSERT CONTAINER

BACKGROUND OF THE INVENTION

1. Field of the Invention

The present invention relates generally to dessert storage containers and more specifically to a multiple tier dessert container which facilitates the storage of decorated dessert items in a convenient and efficient manner that is better than that of the prior art.

2. Discussion of the Prior Art

Dessert storage containers have only one level that dessert items maybe stored on. A single level is satisfactory if the dessert items can be stacked, but if the dessert items are decorated, only one level of storage is possible. This situation will necessitate the use of numerous containers for storing all the decorated desserts. In many cases, no containers exist to transport the decorated dessert. If for example, the decorated dessert item is a cake; the consumer is forced to place the decorated dessert on a plate, insert tooth picks, and place plastic wrap on top of the tooth picks to cover the cake to prevent damaging the appearance thereof; this is not an efficient way of transporting decorated desserts.

Dessert storage containers are also not shaped for holding different types of dessert items such as cakes, pies, cup cakes, donuts, or cookies. Lastly, the appearance conscious consumer will not want to serve the dessert items on an unattractive dessert storage container, they will want to take the items out and put them on an attractive plate instead.

Accordingly, there is a clearly felt need in the art for a multiple tier dessert container which can store numerous decorated dessert items in a convenient and efficient manner, has removable trays which can be individually shaped to hold different types of decorated desserts, and has removable trays which can be attractively colored.

SUMMARY OF THE INVENTION

The primary objective of the present invention is to provide a multiple tier dessert container which can store numerous decorated dessert items in a convenient and efficient manner, has removable trays which can be individually shaped to hold different types of decorated desserts, and has removable trays which can be attractively colored.

According to the present invention, a multiple tier dessert container includes a container, a lid, a plurality of trays, and the option of having at least one handle. The container has a top surface, a bottom surface, a first end, a second end, a first side and a second side. The perimeter of the first end of the container is terminated with an angled edge of uniform thickness. The top surface and the bottom surface may also be referred to as a top wall and a bottom wall, respectively. The first side and the second side may also be referred to as a first wall and second wall, respectively. The lid has a recessed cavity which extends around the perimeter thereof, and is sized to be received by the angled edge of the container such that the lid seals the container.

The first and second sides of the container have a plurality of ledges which are formed therein. The height of the plurality of ledges on the first side is equal to the height of the plurality of ledges on the second side. The top and bottom surfaces are mutually parallel to each other. The first and second sides are mutually parallel to each other. The first side is perpendicular to the bottom surface, and a surface of the second end is perpendicular to the first side. The perimeter of the first end is parallel to the second end.

Each tray has a length, a width and at least one area for storing decorated desserts. The size of the area of each tray is dictated by the type of decorated dessert. The width of each tray is sized to slidably fit into the container. The length of each tray is sized to firmly fit between an attached lid and the second end of the container.

Another preferred embodiment of the container does not have ledges, or trays. The container is sealed with the same lid though, and can be used for storage of other food items besides decorated desserts.

Accordingly, it is an object of the present invention to provide a multiple tier dessert container that can store numerous decorated dessert items in a convenient and efficient manner.

It is a further object of the present invention to provide a multiple tier dessert container which has removable trays that can be individually shaped to hold different types of decorated desserts.

Finally, it is another object of the present invention to provide a multiple tier dessert container that has removable trays which can be attractively colored, and act as dessert dishes.

These and additional objects, advantages, features and benefits of the present invention will become apparent from the following specification.

BRIEF DESCRIPTION OF THE DRAWINGS

FIG. 3*c* is a cross sectional detail view illustrating a plurality of upper and lower ledges in the first and second ends of the container in accordance with the present invention;

FIG. 4 is a top detail view of a container with a handle attached to a first and second side in accordance with the present invention;

FIG. 5*a* is a perspective detail view of a cupcake tray with cupcake cavities, the cupcake tray being sized for storage in the container in accordance with the present invention;

FIG. 5*b* is a perspective detail view of a cupcake tray with cupcake holes, the cupcake tray being sized for storage in the container in accordance with the present invention;

FIG. 6 is a perspective detail view of a cookie tray which is sized for storage in the container in accordance with the present invention;

FIG. 7*a* is a perspective detail view of a cookie rib tray which is sized for storage in the container in accordance with the present invention;

FIG. 7*b* is a cross sectional detail view of a lateral support rib used to hold decorated cookies in place on a cookie tray in accordance with the present invention;

FIG. 8 is a perspective detail view of a cookie grid tray which is sized for storage in the container in accordance with the present invention;

FIG. 9*a* is a perspective detail view of a donut tray which is sized for storage in the container in accordance with the present invention;

FIG. 9*b* is a cross sectional detail view of a lateral support post used to hold decorated donuts in place on a donut tray in accordance with the present invention;

FIG. 10 is a perspective detail view of a pie tray with a pie hole which is sized for storage in the container in accordance with the present invention;

FIG. 11 is a perspective detail view of a cake pan tray with a shallow cavity for the pan of a sheet cake, the cake pan tray being sized for storage in the container in accordance with the present invention;

FIG. 12 is an exploded perspective detail view of a horizontal loading container with a removed lid in accordance with the present invention.

DETAILED DESCRIPTION OF THE PREFERRED EMBODIMENTS

Figure 1:
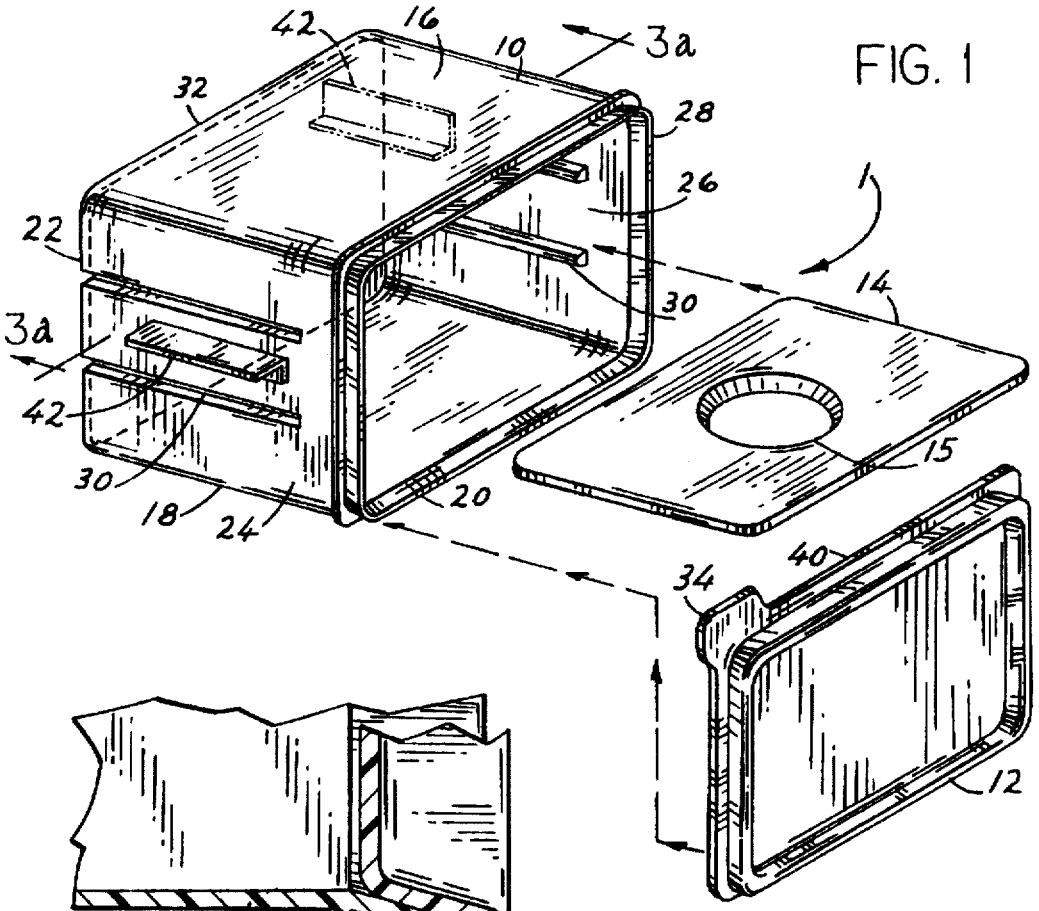
FIG. 1 is an exploded perspective detail view of a multiple tier dessert container with a removed lid and tray in accordance with the present invention.

With reference now to the drawings, and particularly to FIG. 1, there is shown an exploded perspective detail view of a multiple tier dessert container 1 with a lid 12 and a tray 14 removed in accordance with the present invention. The multiple tier dessert container 1 comprises a container 10, the lid 12, and at least one tray 14. The container 10 has a top surface 16, a bottom surface 18, a first end 20, a second end 22, a first side 24 and a second side 26. The perimeter of the first end 20 of the container 10 is terminated with an angled edge 28 of uniform thickness.

The tray 14 has a shallow pie cavity 15 for receiving and laterally restraining standard sized pies, cakes, and decorated jello molds in bowls. The tray 14 may also be flat, such that the tray 14 lacks the cavity 15 for holding sheet cakes or character cakes. The tray 14 may be vacuum molded from a single sheet of plastic.

The first side 24 and the second side 26 have a plurality of convex ledges 30 which are formed therein. The height from the bottom surface 18 to the top of each convex ledge 30 on the first side 24 is equal to the height from the bottom surface 18 to the top of each convex ledge 30 on the second side 26.

The top surface 16 and the bottom surface 18 are mutually parallel to each other. The first side 24 and the second side 26 are mutually parallel to each other. The perimeter of the angled edge 28 is parallel to the wall 32 of the second end 22. The first side 24 is perpendicular to the bottom surface 18, and a wall 32 of the second end 22 is perpendicular to the first side 24. The container 10 can be molded in one piece from a plastic such as a high density polyethylene.

Figure 2:
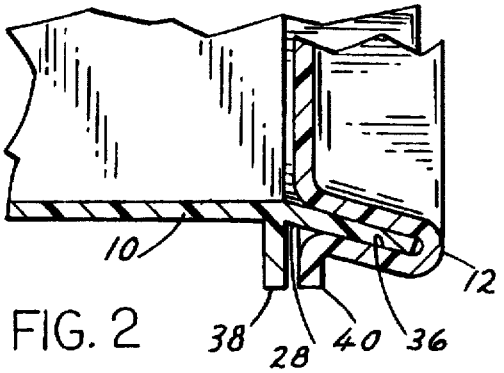
FIG. 2 is a cross sectional detail view of an angled edge of the container inserted into a recessed cavity of a lid in accordance with the present invention.

FIG. 2 shows a cross sectional detail view of the angled edge 28 of the container 10 inserted into a recessed cavity 36 of the lid 12. The recessed cavity 36 extends around the perimeter of the lid 12, and is sized to be received by the angled edge 28 of the container 10 such that the lid 12 seals the container 10. A container lip 38 extends perpendicularly from the perimeter of the container 10 being disposed at substantially the first end 20 of the container 10. A lid lip 40 forms the perimeter of the lid 12. The container lip 38 and lid lip 40 facilitate the easy sealing of the lid 12 to the container 10. With reference to FIG. 1, a lifting edge 34 extends outward from the lid lip 40. The lifting edge 34 facilitates the easy removal of the lid 12 from the container 10. The lid 12 can be molded in one piece from a plastic such as a low density polyethylene.

Figure 3A:
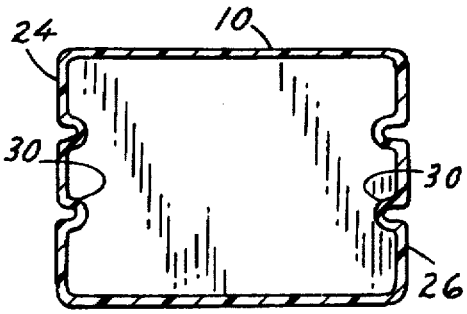
FIG. 3*a* is a cross sectional detail view illustrating a plurality of convex ledges in the first and second ends of the container in accordance with the present invention.

FIG. 3*a* shows a cross sectional detail view illustrating the plurality of convex ledges 30 in the first side 24 and the second side 26 of the container 10. The plurality of convex ledges 30 are formed in the first side 24 and the second side 26 by offsetting a small portion of material in the first side 24 and the second side 26. The tray 14 slidably fits on top of the plurality of convex ledges 30.

Figure 3B:
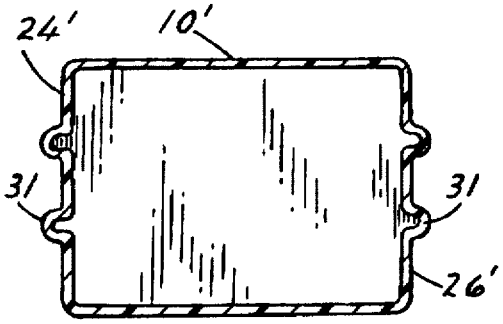
FIG. 3*b* is a cross sectional detail view illustrating a plurality of concave ledges in the first and second ends of the container in accordance with the present invention.

FIG. 3*b* shows a cross sectional detail view illustrating a plurality of concave ledges 31 in the first side 24' and the second side 26' of the container 10. The plurality of convex ledges 31 are formed in the first side 24' and the second side 26' by offsetting a small portion of material in the first side 24' and the second side 26'. The tray 14 slidably fits between the plurality of concave ledges 31.

FIG. 3*c* shows a cross sectional detail view illustrating a plurality of upper ledges 33 and lower ledges 35 in the first side 24" and the second side 26" of the container 10". The plurality of upper ledges 33 and lower ledges 35 extend outward from the first side 24 and the second side 26. The tray 14 slidably fits between the first side 24" and the second side 26" and is vertically constrained between the plurality of upper ledges 33 and lower ledges 35.

FIG. 4 shows a top detail view of the container 10 with a handle 42 attached to the first side 24 and the second side 26. The plurality of handles 42 facilitate the transport of the container 10. A singular handle 42 can also be attached to top surface 16. The handle 42 may be attached to the first side 24, second side 26, or top surface 16 utilizing a plurality of rivets 44, ultrasonic welding, or any other suitable fastening means. The handle may also be molded as an integral part of the container 10. It is preferable that the handle 42 be fabricated from a plastic compound.

FIG. 5*a* shows a perspective detail view of a cupcake tray 50 which is sized to be stored in the container 10. The cupcake tray 50 has a length, a width, and a plurality of cupcake cavities 48 sized to receive and laterally restrain a plurality of decorated cupcakes 46. The shape and size of the cupcake cavity 48 can be made to sized and shaped to hold any standard sized cupcake, or muffin. The cupcake cavity can also be used to hold decorated jello products or petits fours, tiny frosted cakes. The width of the cupcake tray 50 is sized to slidably fit in the container 10. The length of the cupcake tray 50 is sized to fit firmly between the attached lid 12 and the wall 32 of the container 10. The cupcake tray 50 may be vacuum molded from a single sheet of plastic.

FIG. 5*b* shows a perspective detail view of a cupcake tray 50' which is sized to be stored in the container 10. The cupcake tray 50' has a length, a width, and a plurality of cupcake holes 49 sized to receive and laterally restrain a plurality of decorated cupcakes 46. The diameter of the cupcake holes 49 are sized to hold the body of the cupcake 46. The width of the cupcake tray 50' is sized to slidably fit in the container 10. The length of the cupcake tray 50' is sized to fit firmly between the attached lid 12 and the wall 32 of the container 10. The cupcake tray 50' may be vacuum molded from a single sheet of plastic.

FIG. 6 shows a perspective detail view of a cookie tray 56 which is sized to be stored in the container 10. The cookie tray 56 has a length, a width, and a plurality of cookie cavities 54 sized to receive and laterally restrain a plurality of decorated cookies 52. The cookie cavity 54 is a shallow bore which can be varied in diameter to accommodate different sizes of decorated cookies 52. The width of the cookie tray 56 is sized to slidably fit in the container 10. The length of the cookie tray 56 is sized to fit firmly between the attached lid 12 and the wall 32 of the container 10. The cookie tray 56 may be vacuum molded from a single sheet of plastic.

FIG. 7*a* shows a perspective detail view of a cookie rib tray 66 which is sized to be stored in the container 10. The cookie rib tray 66 has a length, a width, and a plurality of lateral support ribs 68 which prevent the lateral movement of decorated cookies 52, during transit. The cookie rib tray 66 may also be used to hold dessert bars, candies or brownies. The width of the cookie rib tray 66 is sized to slidably fit the container 10. The length of the cookie rib tray 66 is sized to fit firmly between the attached lid 12 and the wall 32 of the container 10. The cookie rib tray 66 may be vacuum molded from a single sheet of plastic.

FIG. 7*b* shows a cross sectional detail view of a lateral support ribs 68 used to laterally restrain a plurality of decorated cookies 52 on the cookie rib tray 66. The plurality of lateral support ribs 68 are formed in the cookie rib tray 66 by offsetting a portion of material in the cookie tray 62.

FIG. 8 shows a perspective detail view of a cookie grid tray 57 which is sized to be stored in the container 10. The cookie grid tray 57 comprises a base 61 and a grid 59. The base 61 has a length, and a width. The base may be stamped from a single sheet of plastic. The grid 59 has a plurality of compartments 65, each compartment 65 is sized to receive and laterally restrain a decorated cookie 52. The cookie grid tray may also be used to hold dessert bars, candies or brownies. The grid 59 maybe molded out of one piece of plastic. The grid 59 is attached to the base 61 using cement, ultrasonic welding or any other suitable manufacturing means. The width of the cookie grid tray 57 is sized to slidably fit in the container 10. The length of the cookie grid tray 57 is sized to fit firmly between the attached lid 12 and the wall 32 of the container 10.

FIG. 9*a* shows a perspective detail view of a donut tray 62 which is sized to be stored in the container 10. The donut tray 62 has a length, a width, and a plurality of lateral support posts 60 sized to fit into a decorated donut hole 64 of a decorated donut 58 and laterally restrain thereof. The width of the donut tray 62 is sized to slidably fit in the container 10. The length of the donut tray 62 is sized to fit firmly between the attached lid 12 and the wall 32 of the container 10. The donut tray 62 may be vacuum molded from a single sheet of plastic.

FIG. 9*b* shows a cross sectional detail view of a lateral support post 60 used to hold a plurality of decorated donuts 58 in place on a donut tray 62. The plurality of lateral support posts are formed in the donut tray 62 by offsetting a portion of material in the donut tray 62.

FIG. 10 shows a perspective detail view of a pie tray 14' which is sized to be stored in the container 10. The pie tray 14' has a length, a width, and a pie hole 17 to receive and laterally restrain a pie tin or round cake pan. The diameter of the pie hole 17 is sized to hold the body of a pie tin, or a bowl which contains a decorated jello dessert. The width of the pie tray 14' is sized to slidably fit in the container 10. The length of the pie tray 14' is sized to fit firmly between the attached lid 12 and the wall 32 of the container 10. The pie tray 14' may be stamped from a single sheet of plastic.

FIG. 11 shows a perspective detail view of a cake pan tray 70 which is sized to be stored in the container 10. The cake pan tray 70 has a length, a width, and a shallow cavity 72 for receiving and laterally restraining the pan of a sheet cake. The size of the cavity 72 can be varied in size to hold any standard sheet cake pan. The width of the cake pan tray 70 is sized to slidably fit in the container 10. The length of the cake pan tray 70 is sized to fit firmly between the attached lid 12 and the wall 32 of the container 10. The cake pan tray 70 may be vacuum molded from a single sheet of plastic.

FIG. 12 shows an exploded perspective detail view of a horizontal loading container 2 with a lid 12 removed. The horizontal loading container 2 comprises a container 10''' and the lid 12. The horizontal loading container 2 is the same as the multiple tier dessert container 1 disclosed in FIG. 1, but does not have the convex ledges 30 and tray 14. A multitude of items may be placed inside the container 10'''.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A multiple tier dessert container for serving and transporting various types of desserts comprising:

a container having a top wall, a bottom wall, a first end, a second end, a first wall, and a second wall, said first end being open and said second end being closed;

at least one ledge extending from said first wall and at least one ledge extending from said second wall;

an edge which terminates the perimeter of said first end of said container; and a lid having a cavity which continuously follows the perimeter thereof, said cavity contacting at least two sides of said edge, such that said lid seals said container; and at least one tray having a length, and a width, said tray being supported by said plurality of ledges, said tray being sized to slidably fit in said container, said tray having major surface areas facing the top wall and the bottom wall, said tray being structured to restrain at least one food item.

2. The multiple tier dessert container for serving and transporting various types of desserts of claim 1, wherein:

the ledges extending inwardly from said first and second walls, said plurality of ledges having a convex shaped cross section, wherein said tray rests on the top of said plurality of ledges.

3. The multiple tier dessert container for serving and transporting various types of desserts of claim 1, wherein:

the ledges having a concave shaped cross section, wherein said tray slidably fits between the plurality of concave ledges.

4. The multiple tier dessert container for serving and transporting various types of desserts of claim 1, wherein:

wherein said at least one ledge extending from said first wall includes at least one upper ledge extending inwardly from said first wall, wherein said at least one ledge extending from said second wall includes at least one upper ledge extending inwardly from said second wall; and wherein said at least one ledge extending from said first wall also includes at least one lower ledge extending inwardly from said first wall, wherein said at least one ledge extending from said second wall also includes at least one lower ledge extending inwardly from said second wall, wherein said tray being slidable between said upper and lower ledges.

5. The multiple tier dessert container for serving and transporting various types of desserts of claim 1, further comprising:

a handle being attached to said first wall and another handle being attached to said second wall of said container.

6. The multiple tier dessert container for serving and transporting various types of desserts of claim 1, wherein:

said tray being fabricated from a plastic material which can be aesthetically colored to improve the appearance thereof for serving various types of desserts.

7. The multiple tier dessert container for serving and transporting various types of desserts of claim 6, further comprising:

a cupcake tray having cupcake cavities for retaining decorated cupcakes, said cupcake cavities being sized and shaped to retain standard sized cupcake shells.

8. The multiple tier dessert container for serving and transporting various types of desserts of claim 6, further comprising:

a pie tray having a pie cavity for retaining a standard sized pie tin, said pie cavity being sized and shaped to retain a standard sized pie tin.

9. The multiple tier dessert container for serving and transporting various types of desserts of claim 6, further comprising:

a pie tray having a pie hole for retaining a pie tin, said pie hole diameter being sized to retain the body of a standard sized pie tin.

10. The multiple tier dessert container for serving and transporting various types of desserts of claim 6, further comprising:

a cupcake tray having cupcake holes for retaining a plurality of decorated cupcakes, said cupcake hole diameters being sized to retain the body of a plurality of standard sized cupcake shells.

11. The multiple tier dessert container for serving and transporting various types of desserts of claim 6, further comprising:

a cookie tray having a plurality of cookie cavities for retaining decorated cookies, said plurality of cookie cavities having a shallow bore which can be varied in diameter to accommodate different sizes of decorated cookies.

12. The multiple tier dessert container for serving and transporting various types of desserts of claim 6 further comprising:

a donut tray having a plurality of donut lateral support posts sized to fit into a plurality of decorated donut holes, said plurality of donut protrusions being formed in said donut tray by offsetting a portion thereof.

13. The multiple tier dessert container for serving and transporting various types of desserts of claim 6, further comprising:

a cookie rib tray having a plurality of lateral support ribs for laterally restraining a plurality of decorated cookies therein, said plurality of lateral support ribs being formed in said cookie rib tray by offsetting a portion of material thereof.

14. The multiple tier dessert container for serving and transporting various types of desserts of claim 6, further comprising:

a cookie grid tray having a plurality of compartments for storage of a plurality of decorated cookies therein.

15. The multiple tier dessert container for serving and transporting various types of desserts of claim 6, further comprising:

a cake pan tray having a shallow cavity for retaining a sheet cake pan, said shallow cavity being sized to retain a standard sized sheet cake pan.

16. The multiple tier dessert container for serving and transporting various types of desserts of claim 1, wherein:

the ledges extending outwardly from said first and second walls, the ledges having a concave shaped cross section, wherein said tray slides in said plurality of concave ledges.

17. The multiple tier dessert container for serving and transporting various types of desserts of claim 1, further comprising:

a handle being attached to said top wall of said container.

18. A multiple tier dessert container for serving and transporting various types of desserts comprising:

a container having a top wall, a bottom wall, a first end, a second end, a first wall, and a second wall, said first end being open and said second end being closed;

at least one ledge extending inwardly from said first wall and at least one ledge extending inwardly from said second wall, said plurality of ledges having a convex shaped cross section;

an edge which terminates the perimeter of said first end of said container; and a lid having a cavity which continuously follows the perimeter thereof, said cavity contacting at least two sides of said edge, such that said lid seals said container; and a handle being attached to said first wall and another handle being attached to said second wall of said container; and at least one tray having a length, and a width, said tray being supported by said plurality of ledges, said tray being sized to slidably fit in said container, said tray having major surface areas facing the top wall and the bottom wall.

19. The multiple tier dessert container for serving and transporting various types of desserts of claim 18, wherein:

said tray being structured to restrain at least one food.

20. A multiple tier dessert container for serving and transporting various types of desserts comprising:

a container having a top wall, a bottom wall, a first end, a second end, a first wall, and a second wall, said first end being open and said second end being closed;

at least one ledge extending inwardly from said first wall and at least one ledge extending inwardly from said second wall, said plurality of ledges having a convex shaped cross section;

an edge which terminates the perimeter of said first end of said container; and a lid having a cavity which continuously follows the perimeter thereof, said cavity contacting at least two sides of said edge, such that said lid seals said container; and a handle being attached to said top wall of said container; and at least one tray having a length, and a width, said tray being supported by said plurality of ledges, said tray being sized to slidably fit in said container, said tray having major surface areas facing the top wall and the bottom wall.

21. The multiple tier dessert container for serving and transporting various types of desserts of claim 20, wherein:

said tray being structured to restrain at least one food.

22. A multiple tier dessert container for serving and transporting various types of desserts comprising:

a container having a top wall, a bottom wall, a first end, a second end, a first wall, and a second wall, said first end being open and said second end being closed;

at least one ledge extending outwardly from said first wall and at least one ledge extending outwardly from said second wall, said plurality of ledges having a concave cross section, wherein said tray slides in said plurality of concave ledges;

an edge which terminates the perimeter of said first end of said container; and a lid having a cavity which continuously follows the perimeter thereof, said cavity contacting at least two sides of said edge, such that said lid seals said container; and a handle being attached to said first wall and another handle being attached to said second wall of said container; and at least one tray having a length, and a width, said tray being supported by said plurality of ledges, said tray being sized to slidably fit in said container, said tray having major surface areas facing the top wall and the bottom wall.

23. The multiple tier dessert container for serving and transporting various types of desserts of claim 22, wherein:

said tray being structured to restrain at least one food.

24. A multiple tier dessert container for serving and transporting various types of desserts comprising:

a container having a top wall, a bottom wall, a first end, a second end, a first wall, and a second wall, said first end being open and said second end being closed;

at least one ledge extending outwardly from said first wall and at least one ledge extending outwardly from said second wall, said plurality of ledges having a concave shaped cross section, wherein said tray slides in said plurality of concave ledges;

an edge which terminates the perimeter of said first end of said container; and a lid having a cavity which continuously follows the perimeter thereof, said cavity contacting at least two sides of said edge, such that said lid seals said container; and a handle being attached to said top wall of said container; and at least one tray having a length, and a width, said tray being supported by said plurality of ledges, said tray being sized to slidably fit in said container, said tray having major surface areas facing the top wall and the bottom wall.

25. The multiple tier dessert container for serving and transporting various types of desserts of claim 24, wherein:

said tray being structured to restrain at least one food.

26. A multiple tier dessert container for serving and transporting various types of desserts comprising:

a container having a top wall, a bottom wall, a first end, a second end, a first wall, and a second wall, said first end being open and said second end being closed;

at least one upper ledge extending inwardly from said first wall, at least one upper ledge extending inwardly from said second wall, at least one lower ledge extending inwardly from said first wall, at least one lower ledge extending inwardly from said second wall, wherein said tray being slidable between said upper and lower ledges;

an edge which terminates the perimeter of said first end of said container; and a lid having a cavity which continuously follows the perimeter thereof, said cavity contacting at least two sides of said edge, such that said lid seals said container; and a handle being attached to said first wall and another handle being attached to said second wall of said container; and at least one tray having a length, and a width, said tray being supported by said plurality of ledges, said tray being sized to slidably fit in said container, said tray having major surface areas facing the top wall and the bottom wall.

27. The multiple tier dessert container for serving and transporting various types of desserts of claim 26, wherein:

said tray being structured to restrain at least one food.

28. A multiple tier dessert container for serving and transporting various types of desserts comprising:

a container having a top wall, a bottom wall, a first end, a second end, a first wall, and a second wall, said first end being open and said second end being closed;

at least one upper ledge extending inwardly from said first wall, at least one upper ledge extending inwardly from said second wall, at least one lower ledge extending inwardly from said first wall, at least one lower ledge extending inwardly from said second wall, wherein said tray being slidable between said upper and lower ledges;

an edge which terminates the perimeter of said first end of said container; and a lid having a cavity which continuously follows the perimeter thereof, said cavity contacting at least two sides of said edge, such that said lid seals said container; and a handle being attached to said top wall of said container; and at least one tray having a length, and a width, said tray being supported by said plurality of ledges, said tray being sized to slidably fit in said container, said tray having major surface areas facing the top wall and the bottom wall.

29. The multiple tier dessert container for serving and transporting various types of desserts of claim 28, wherein:

said tray being structured to restrain at least one food.

* * * * *